US005557976A

United States Patent [19]

Moribayashi et al.

[11] Patent Number: 5,557,976

[45] Date of Patent: Sep. 24, 1996

[54] PLANETARY GEAR REDUCTION STARTER

[75] Inventors: Satoshi Moribayashi; Shuzo Isozumi; Akira Morishita, all of Himeji, Japan

[73] Assignee: Mitsubishi Denki Kabushiki Kaisha, Tokyo, Japan

[21] Appl. No.: 377,410

[22] Filed: Jan. 24, 1995

[30] Foreign Application Priority Data

Apr. 27, 1994 [JP] Japan ..... 6-114616

[51] Int. Cl.[6] ..... F02N 15/06

[52] U.S. Cl. ..... 74/7 E; 74/7 A

[58] Field of Search ..... 74/7 A, 7 E

[56] References Cited

U.S. PATENT DOCUMENTS 4,926,706 5/1990 Isozumi ..... 74/7 E X 5,086,658 2/1992 Isozumi ..... 74/7 E 5,189,921 3/1993 Nagashima et al. ..... 74/7 A

*Primary Examiner*—Allan D. Herrmann

*Attorney, Agent, or Firm*—Sughrue, Mion, Zinn, Macpeak & Seas

[57] ABSTRACT

In a planetary gear reduction starter, a motor, a planetary gear reduction mechanism connected to the front end of the motor, a rotary output shaft extending from the planetary gear reduction mechanism and an overrunning clutch engageable with the rotary output shaft are assembled together without using a front bracket.

3 Claims, 18 Drawing Sheets

PLANETARY GEAR REDUCTION STARTER

BACKGROUND OF THE INVENTION

1. Field of the Invention

The present invention relates to a planetary gear reduction starter used for a vehicle. In particular, the present invention relates to an assembling structure for a planetary gear reduction unit.

2. Discussion of Background

FIG. 17 is a cross-sectional view showing the overall construction of an example of a conventional planetary gear reduction starter. In FIG. 17, reference numeral 1 designates the armature of a d.c. motor, numeral 2 designates a rotating shaft for the armature 1, numeral 3 designates a commutator attached to an end (on the left side in the drawing) of the armature 1, and numeral 4 designates a brush holder holding a brush, which is fixed to a rear bracket 6 by means of a bolt 5. A bearing 7 which supports a rear end portion of the rotating shaft 2 of the armature 1 is fitted to a recess formed in the rear bracket 6. A permanent magnet 8*a* is fixed to the inner circumferential surface of a yoke 8 in the d.c. motor and produces a magnetic field. An end of the yoke 8, which is on the side of the commutator 3, is in contact with and fitted to the rear bracket 6. The other end of the yoke, which is on the side of a rotatory output shaft 17, is connected with a front bracket 10 in which an internal gear wheel 9 constituting a planetary gear reduction device 33 is fitted to a shoulder portion 10*a* which is formed in the inner circumferential surface of the front bracket 10. The yoke 8 is defined from the front bracket 10 by means of a flange-like plate portion 8*b* which is extended inwardly in the radial direction from the other end of the yoke 8 in one piece. Hereinbelow, the term "front" with respect to any element in the planetary gear reduction starter means the right side of the element in the drawings and the term "rear" means the left side.

A projection 9*i* formed in the outer circumferential surface of a flange portion of the internal gear wheel 9 is fitted to the shoulder portion 10*a* in a recess formed in the inner circumferential surface of the front bracket 10 so that it is prevented from moving in the circumferential direction. A through bolt 32 is inserted through the rear bracket b and is engaged with a thread portion (not shown) formed in the front bracket 10. Accordingly, the internal gear wheel 9 is cramped between the shoulder portion 10*a* of the front bracket 10 at its one end and the plate portion 8*b* at its other end thereby being prevented from moving in the axial direction.

A spur gear 12 is formed at a front end portion of the rotary output shaft 2 of the armature 1. A planetary gear wheel 13 is meshed with the spur gear 12. A bearing 14 is fitted to the inner circumferential surface of the planetary gear wheel 13, and the bearing 14 is supported by a supporting pin 15. A flange 16 for firmly securing the supporting pin 15 constitutes an arm for the planetary gear reduction device 33. The arm is formed integrally with the rotary output shaft 17, which is, in turn, supported by a sleeve bearing 18 which is fitted to the inner circumferential surface of a projecting portion of the internal gear wheel 9. A sleeve bearing 19 fitted to a recess formed in rear of the spur gear 12 of the rotary output shaft 17 supports a front end portion of the rotary shaft 2 of the armature 1. Further, a steel ball 20 is disposed between the front end of the rotary shaft 2 of the armature and the rotary output shaft 17 to bear a thrust load.

A helical spline 21 is formed in an outer circumferential portion of the rotary output shaft 17, and an overrunning clutch 22 is in spline-engagement with the helical spline so as to be slidable along the axial direction. A pinion 23 is connected to the overrunning clutch 22. A stopper 24 is disposed to restrict the amount of movement of the pinion 23 in the axial direction. A sleeve bearing 25 for supporting the rotary output shaft 17 is fitted to the inner circumferential surface of an opening 10b formed at a front portion of the front bracket 10.

A lever 26 made of a resinous material is pivotally supported by the front bracket 10 wherein an end of the lever 26 is connected to a plunger 28 in an electromagnetic switch 27 and the other end is engaged with a rear portion of the overrunning clutch 22. Numeral 29 designates a lead wire for connecting the electromagnetic switch 27 to the brush 4. The other end of the lead wire is fixed to a cap 31 by means of a nut 30 on the side of the electromagnetic switch 27.

FIG. 18 shows another example of a conventional planetary gear reduction starter having a construction different from that shown in FIG. 17 wherein the same reference numerals designate the same or corresponding parts. Namely, a center plate 11 and a center bracket 34 accommodating the internal gear wheel 9 are disposed between the edge surface of an opening of the yoke 8 in a tubular form and the shoulder portion 10*a* of the front bracket 10 wherein a through bolt (not shown) is inserted from a closed end portion of the yoke 8 so that the planetary gear reduction device 33 is fixed in a position by engaging the through bolt with a thread portion formed in the front bracket 10.

In each of the conventional planetary gear reduction starters having the construction described above, when a key switch (not shown) is turned on, a current is passed through the electromagnetic switch 27 whereby a voltage is applied to the brush 4 through the lead wire 29 and a torque is produced in the armature 1. The rotation of the armature 1 is reduced by the planetary gear reduction device 33 and a reduced speed is transmitted to the overrunning clutch 22. On the other hand, when the electromagnetic switch 27 becomes conductive, the plunger 28 is moved in the left direction in the drawing and the movement of the plunger 28 is transmitted to the overrunning clutch 22 through the lever 26. Accordingly, the overrunning clutch 22 moves forwardly, and the pinion 23 is brought to engagement with a ring gear (not shown) on the side of the engine.

In the conventional planetary gear reduction starters, it is necessary to fasten the through bolt to the front bracket in order to fix the planetary gear reduction device. Accordingly, when there is no front bracket, it is impossible to fix the planetary gear reduction device to the yoke of the motor. However, if the front bracket can be removed and the planetary gear reduction device can be connected to the yoke, the packaging of the starters can be compact and transportation and storage of the starters by using boxes can be easy. However, there is a possibility of disconnection of the planetary gear reduction device from the yoke due to vibrations and careless handling, whereby a planetary gear wheel or a pole may come off and dust may enter into the device. This may cause a fault in an assembled product.

SUMMARY OF THE INVENTION

It is an object of the present invention to provide a planetary gear reduction starter capable of fixing the planetary gear reduction device to the yoke without the front bracket.

According to the present invention, there is provided a planetary gear reduction starter comprising a motor, a planetary gear reduction device connected to a front end portion of the motor, an overrunning clutch slidably engaged with a helical spline formed in a rotary output shaft for the planetary gear reduction device, and a front bracket disposed in front of the motor to surround the planetary gear reduction device and the overrunning clutch, wherein the motor, the planetary gear reduction device, the rotary output shaft and the overrunning clutch are assembled in one piece in the absence of the front bracket.

In the planetary gear reduction starter of the present invention, the planetary gear reduction device can be fixed to the yoke without using the front bracket. Accordingly, the packaging of the starter can be compact and storage and transportation can be easy.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
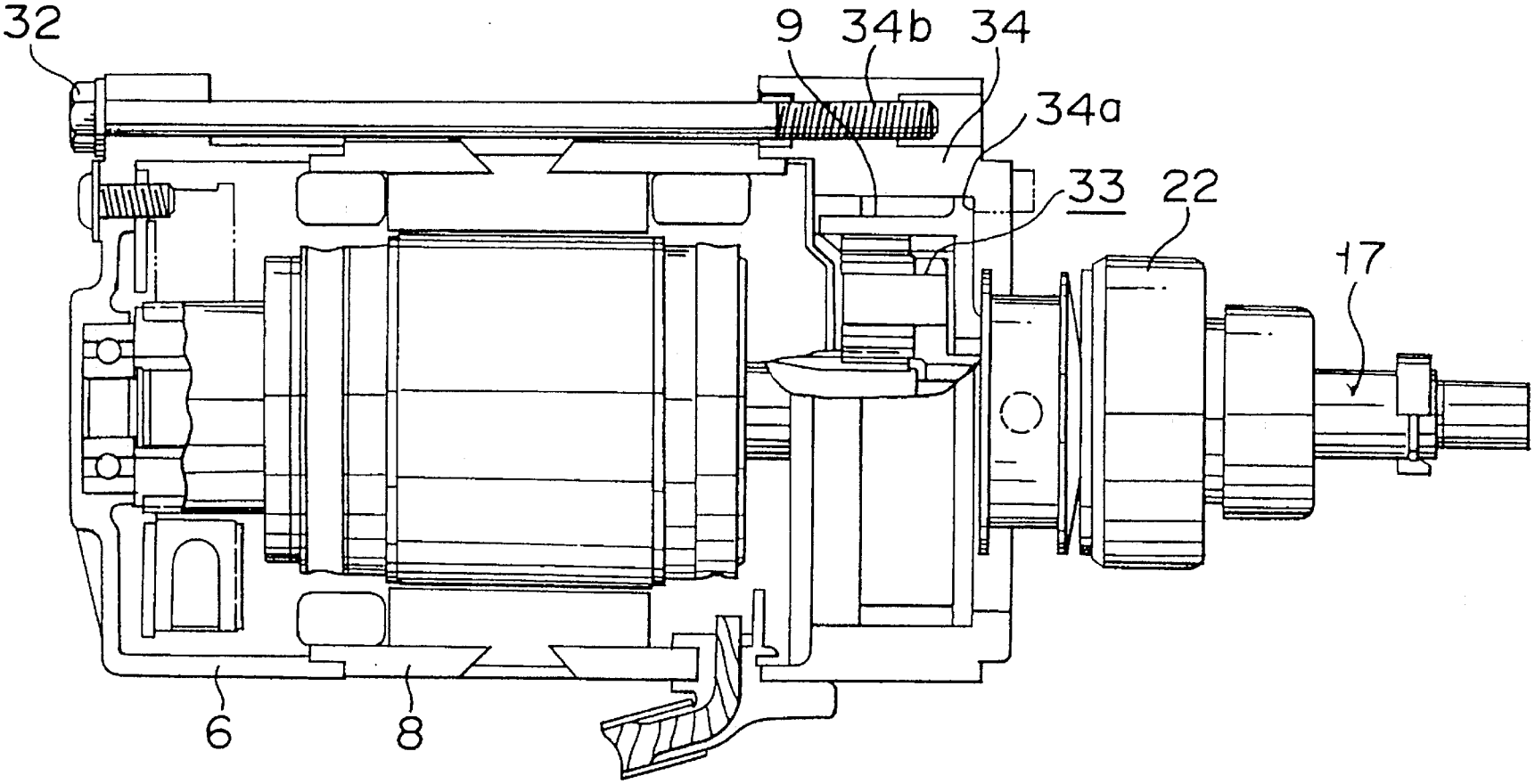
FIG 1. is a cross-sectional view partly cross-sectioned of a first embodiment of the planetary gear reduction starter of the present invention.

Preferred embodiments of the planetary gear reduction starter according to the present invention will be described in detail with reference to the drawings wherein the same reference numerals designate the same or corresponding parts.

EXAMPLE 1

FIG. 1 shows the first embodiment of the present invention. In FIG. 1, a center bracket 34 is connected to the front end of a yoke 8 (i.e. on the right side of the yoke in FIG. 1). An internal gear wheel 9 which constitutes a planetary gear reduction device 33 is fitted to and engaged with a step portion 34*a* formed in an inner circumferential portion of the center bracket 34. An internal thread 34*b* is formed in an outer circumferential portion of the center bracket, the thread 34*b* extending parallel to the axis of a rotary output shaft 17. A through bolt 32 is inserted in a rear bracket 6 and the top end of the through bolt 32 is engaged with the internal thread 34*b* whereby the center bracket 34 is fixed to the rear bracket 6 by interposing the yoke 8 therebetween. Numeral 22 designates an overrunning clutch which is the same as that used for the conventional starter.

Namely, the present invention is featurized by assembling in one piece a motor portion, a planetary gear reduction device portion, the rotary output shaft and the overrunning clutch in the absence of a front bracket.

In detail, since the internal gear wheel 9 is fitted to the center bracket 34, and the center bracket 34 and the rear bracket 6 between which the yoke 8 is interposed, are fixed by inserting and fastening the through bolt 32, the planetary gear reduction device portion can be fixed to the yoke 8 without screw-connection to the front bracket as in conventional planetary gear reduction starters.

Thus, according to the present invention, the planetary gear reduction device can be fixed to the yoke without using the front bracket. Further, a large scale production of starter is possible since any type of front brackets, levers and switches can be used for the starter having the above-mentioned structure. Further, the front brackets can be assembled at any different place. Accordingly, there is no danger of disconnection of assemblies during transportation.

At any time, a planetary gear reduction starter can be completed by attaching a front bracket to the assembly shown in FIG. 1 and fastening the front bracket to the assembly.

The same effect is obtainable with an overhang type front bracket without having a nose portion.

EXAMPLE 2

Figure 2:
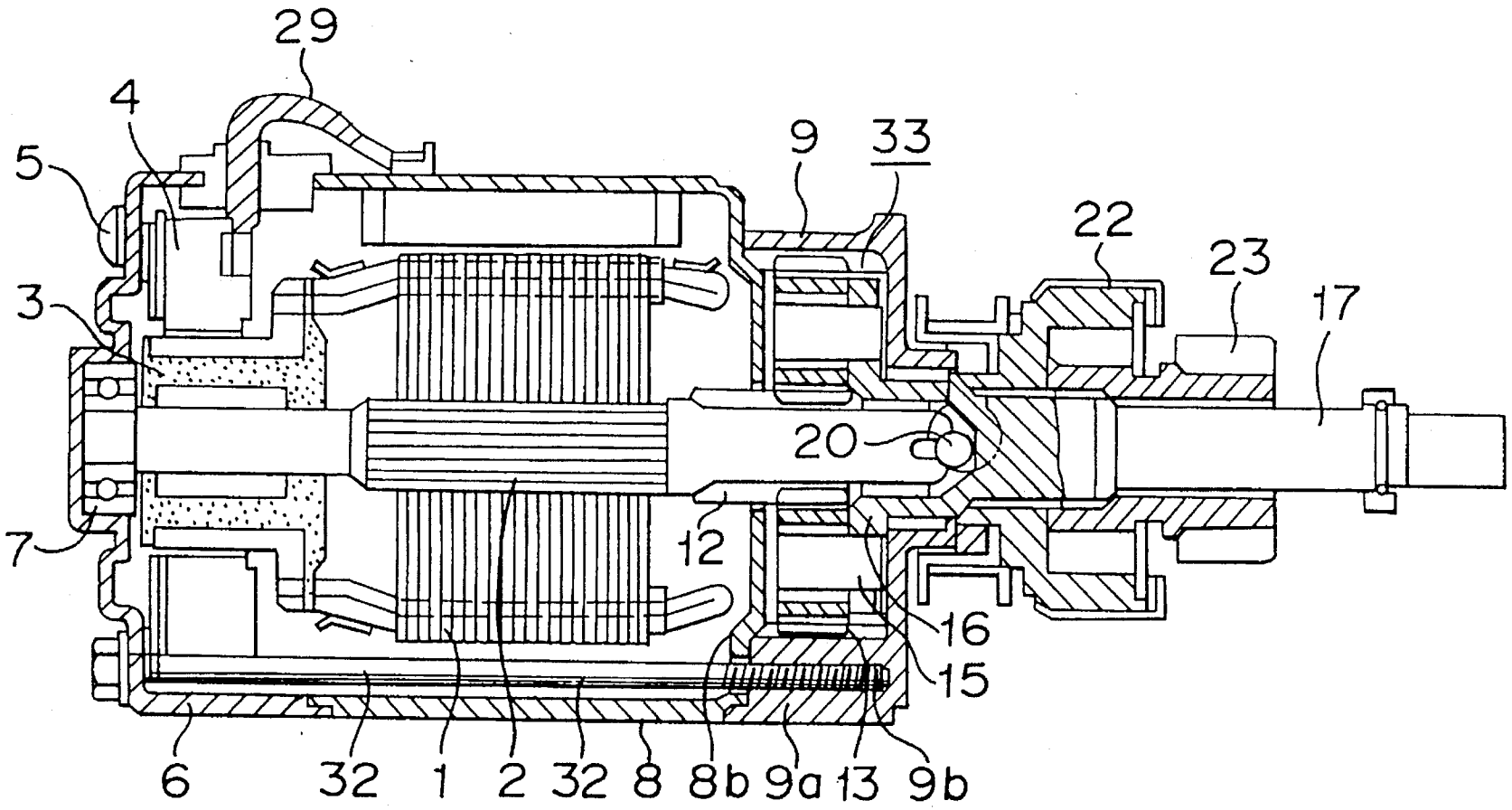
FIG. 2 is a cross-sectional view showing a second embodiment of the present invention.

In the first embodiment, the center bracket 34 and the through bolt 32 to be engaged with the same are used. However, as shown in FIG. 2, an extension 9*a* may be formed at a portion of the circumferential surface of the internal gear wheel 9 of the planetary gear reduction device 33 wherein an internal thread 9*b* is formed in the axial direction of the extension 9*a* and the end of the through bolt 32 is engaged with the internal thread 9*b*. Thus, the same effect as by the first embodiment can be obtained without using the center bracket 34 used in the first embodiment. Namely, in the second embodiment, the internal gear wheel 9 serves the role of a center bracket.

EXAMPLE 3

Figure 3:
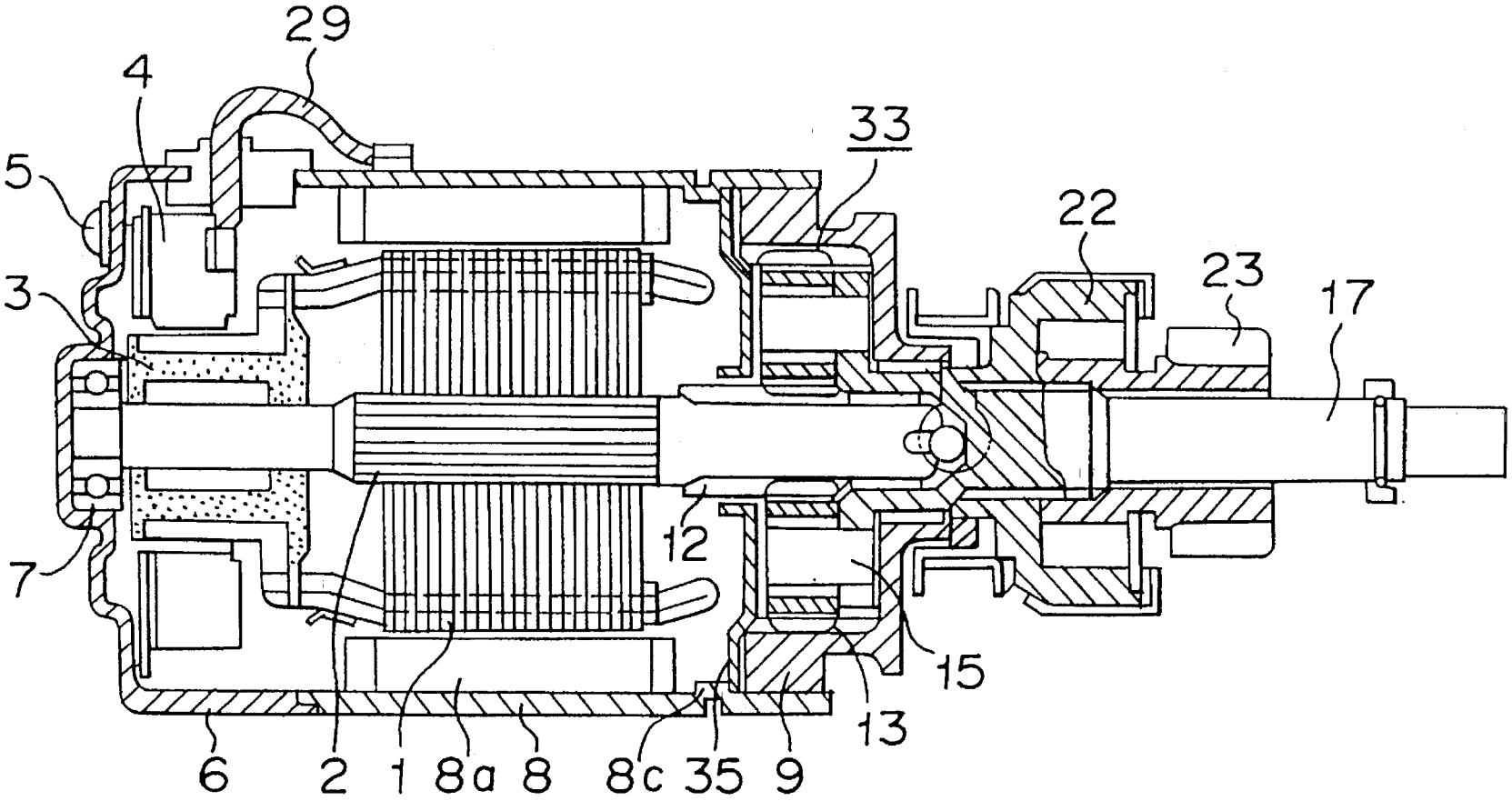
FIG. 3 is a cross-sectional view showing a third embodiment of the present invention.
Figure 4:
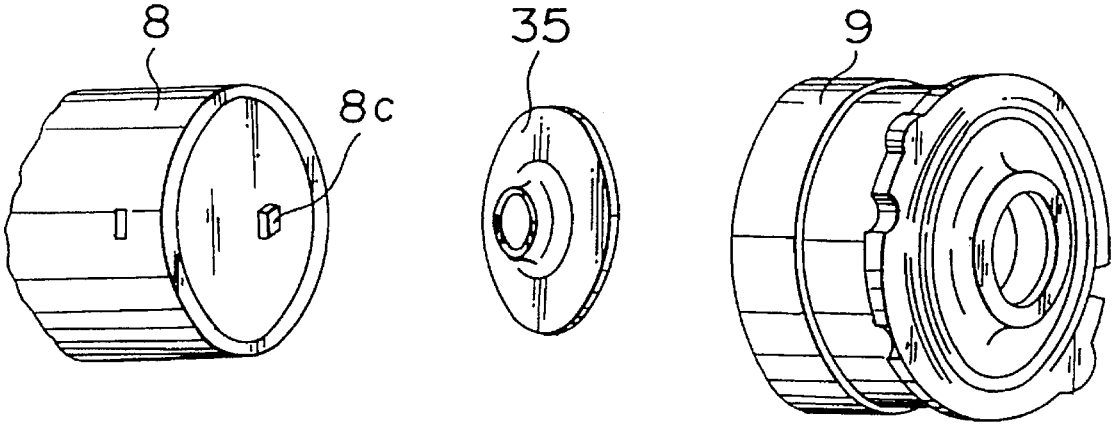
FIG. 4. is a perspective view in a disassembled state of important parts of the third embodiment of the present invention.

FIGS. 3 and 4 show the third embodiment of the present invention. A tubular yoke 8 has a projection 8*c* in the inner circumferential surface and near its one open end. A center plate 35, which is separately prepared, is in contact with a side portion of the projection 8*c* so that the movement of the center plate 35 in the axial direction toward the armature 1 is restricted. The internal gear wheel 9 is forcibly inserted in the opening of the yoke 8 and in contact with the center plate 35 and is fixed with a frictional contact. The internal gear wheel 9 may be directly inserted forcibly in the yoke or may be fixed to it by interposing a ring-like body. The casing for the internal gear wheel may be made of a resinous material by one-piece molding.

EXAMPLE 4

Figure 5:
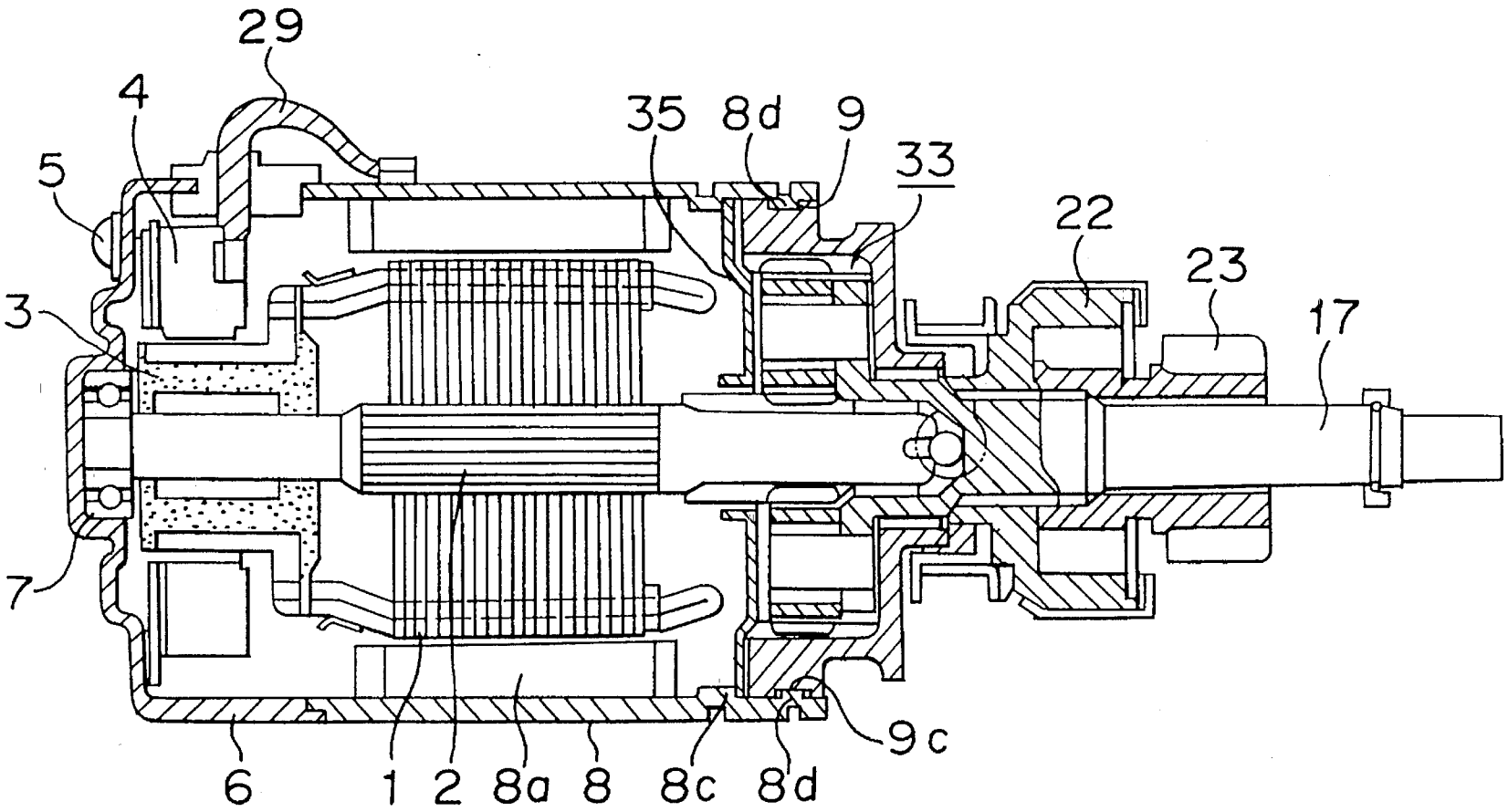
FIG. 5 is a cross-sectional view showing a fourth embodiment of the present invention.
Figure 6:
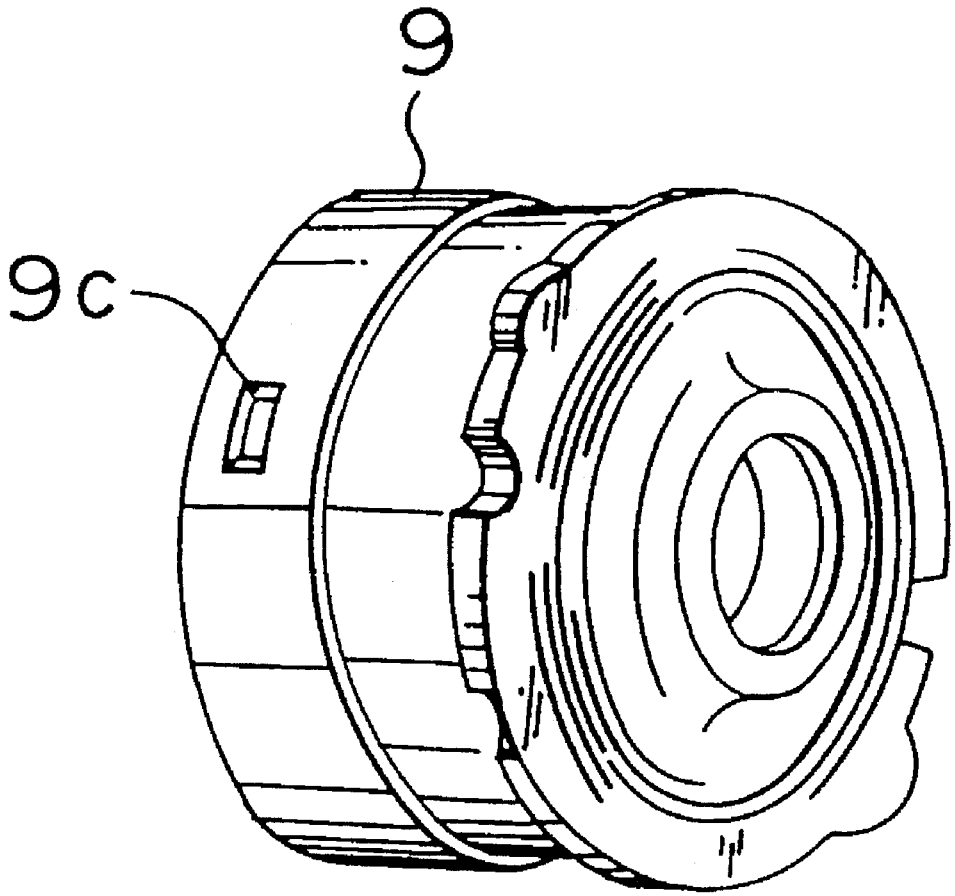
FIG. 6 is a perspective view showing an internal gear wheel portion used for the fourth embodiment of the present invention.

FIGS. 5 and 6 show the fourth embodiment of the present invention. In this embodiment, a second projection 8*d* is formed at a position behind (on the side of the opening) the first projection 8*c* formed in the inner circumferential surface of the yoke 8 which is the same as that of Example 2. The second projection 8*d* is adopted to fit into a recess 9*c* formed in the outer circumferential surface of the internal gear wheel 9. In this embodiment, the casing of the internal gear wheel 9 is also made of a resilient material such as synthetic resin so that the second projection 8*d* and the recess 9*c* can be fitted by utilizing elasticity.

With such construction, the fitting for position-determination of the internal gear wheel 9 to the yoke 8 can be certainly effected. Accordingly, it is unnecessary to pay careful attention to the accuracy in the dimensions of the inner diameter of the yoke and the outer diameter of the internal gear wheel.

EXAMPLE 5

Figure 7:
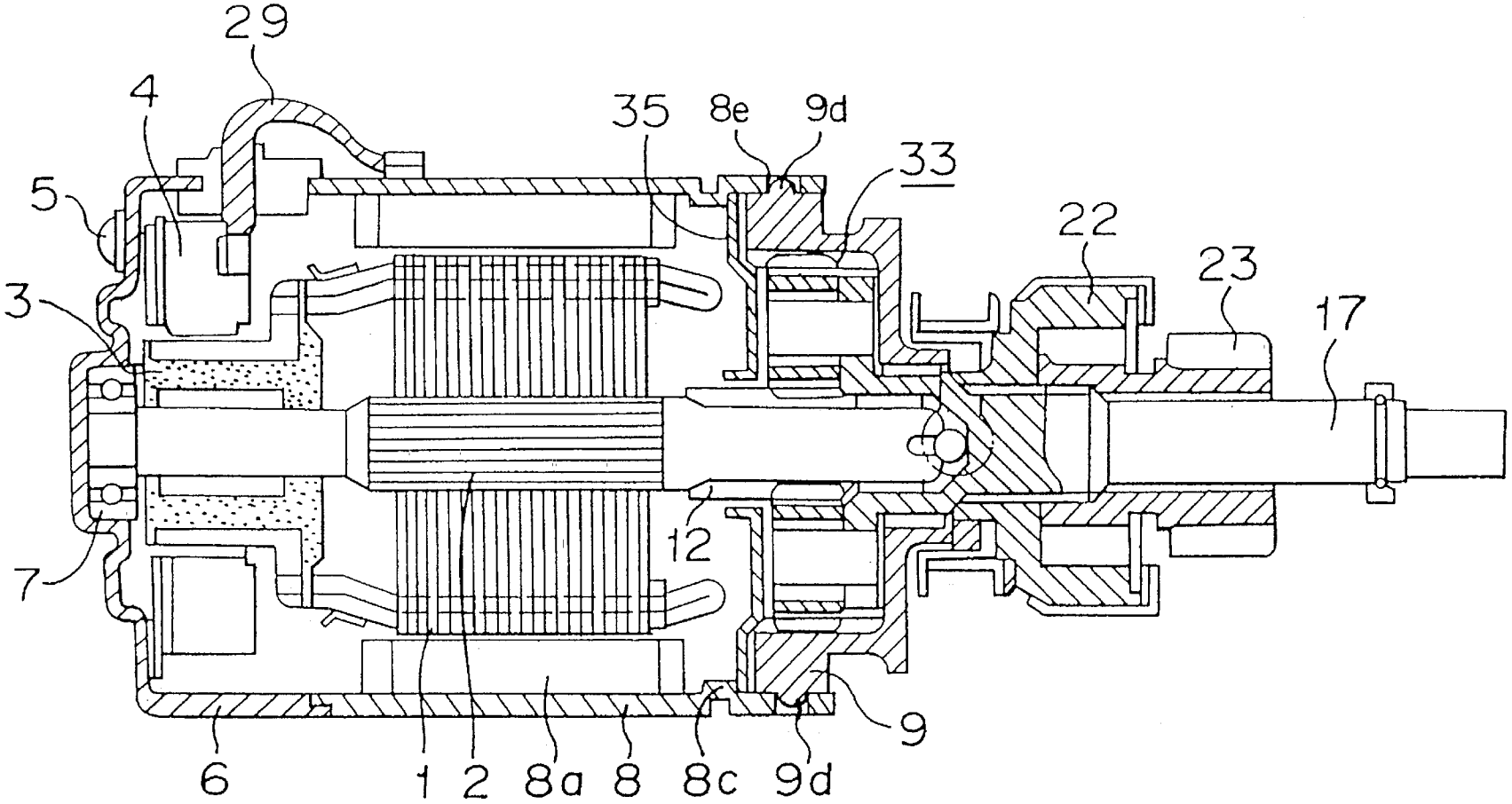
FIG. 7 is a cross-sectional view showing a fifth embodiment of the present invention.
Figure 8:
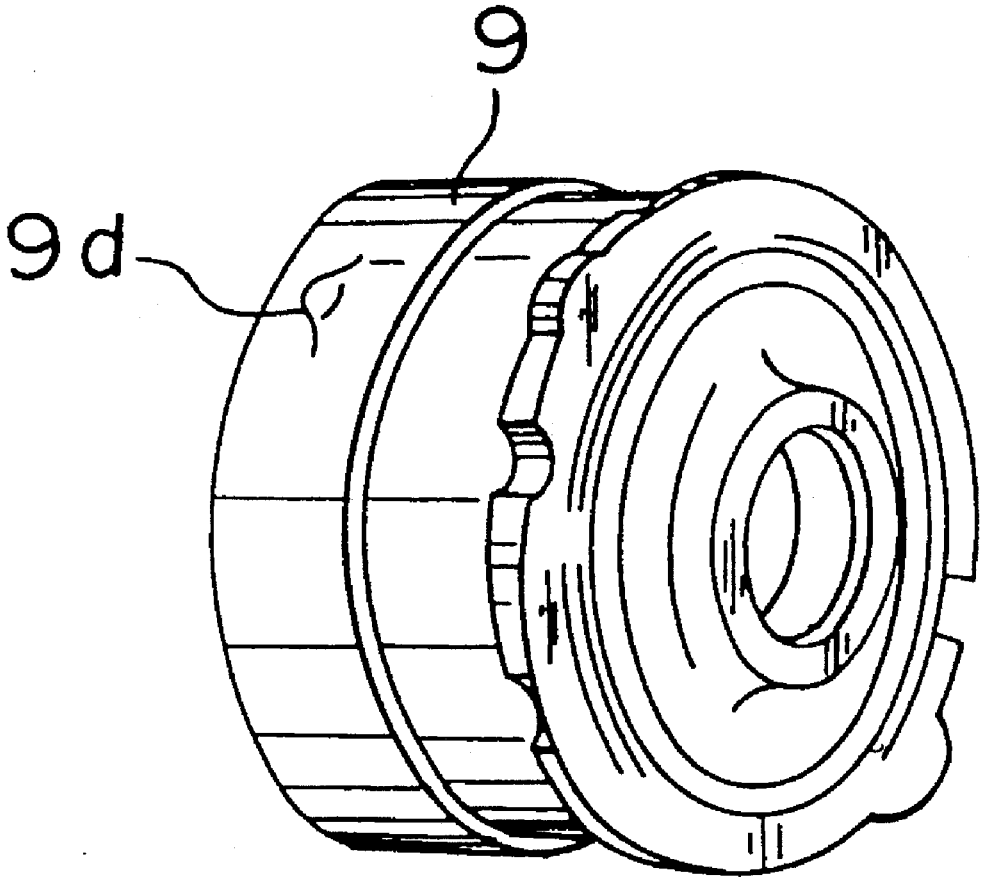
FIG. 8 is a perspective view showing an internal gear wheel portion used for the fifth embodiment of the present invention.

FIGS. 7 and 8 show the fifth embodiment of the present invention, which is a modification of the fourth embodiment. A projection 9*d* is formed in the outer circumferential surface of the internal gear wheel 9, and a fitting hole or recess 8*e* having a circular shape, for instance, is formed in the yoke 8 at the position corresponding to the projection 9*d*. The internal gear wheel 9 is fixed by fitting the projection 9*d* to the fitting hole or recess 8*e*. The same effect as by the fourth embodiment is obtainable. In this embodiment, the internal gear wheel 9 is also made of a resilient material such as synthetic resin, for instance.

In Examples 4 and 5, since the position of the internal gear wheel 9 to the yoke 8 can be determined, it is possible to determine the position of a groove for the through bolt when a front bracket is attached to the assembly to complete the starter.

EXAMPLE 6

Figure 9:
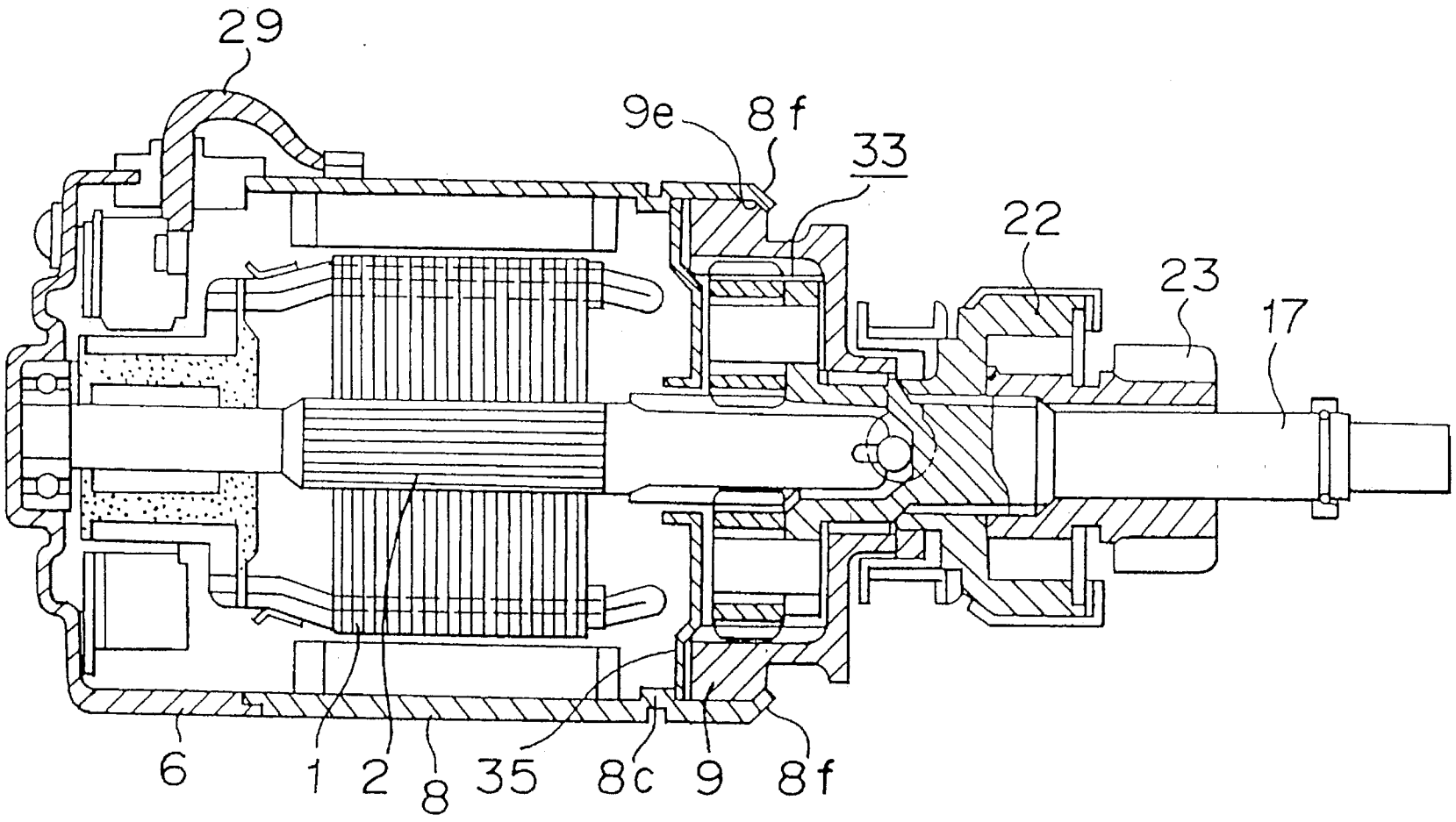
FIG. 9 is a cross-sectional view showing a sixth embodiment of the present invention.
Figure 10:
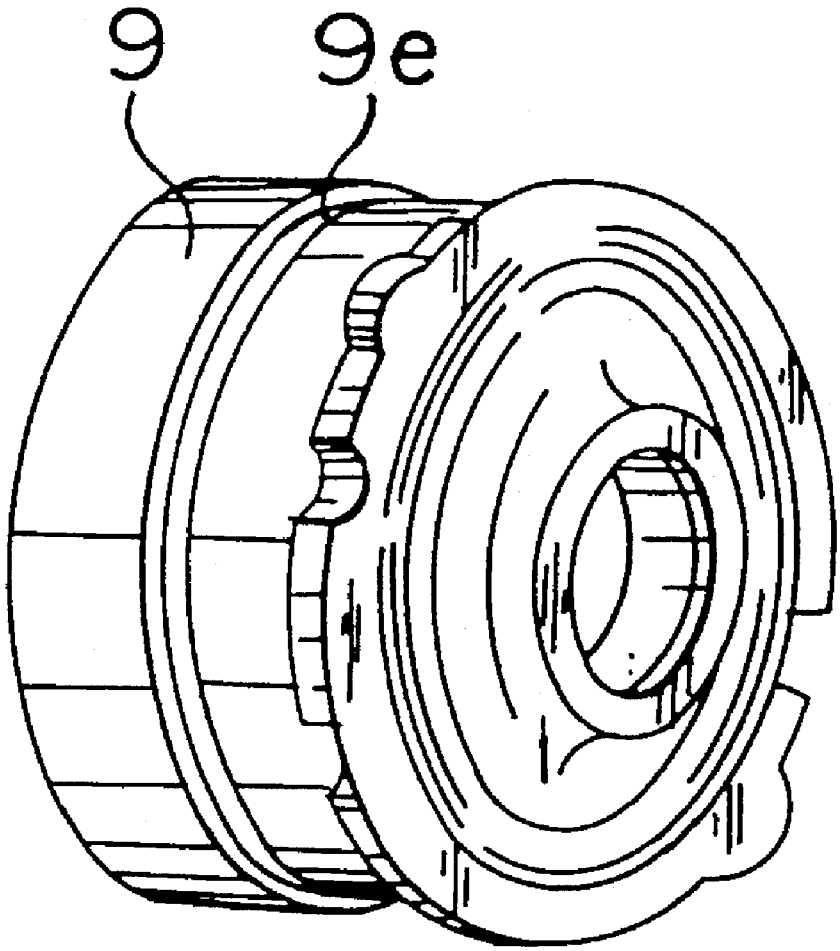
FIG. 10 perspective view showing an internal gear wheel portion used for the sixth embodiment of the present invention.

FIGS. 9 and 10 show the sixth embodiment of the present invention. At least a portion 8*f* of the edge of the opening of the yoke 8 is made deformable inwardly, and a tapered portion 9*e* is formed in an outer edge of the internal gear wheel 9. Then, after the internal gear wheel 9 is fitted to the opening portion of the yoke 8, the deformable portion 8*f* is bent in to fix the internal gear wheel 9. The deformable portion for bending may be formed at a part or in the entirety of the edge of the opening of the yoke.

EXAMPLE 7

Figure 11:
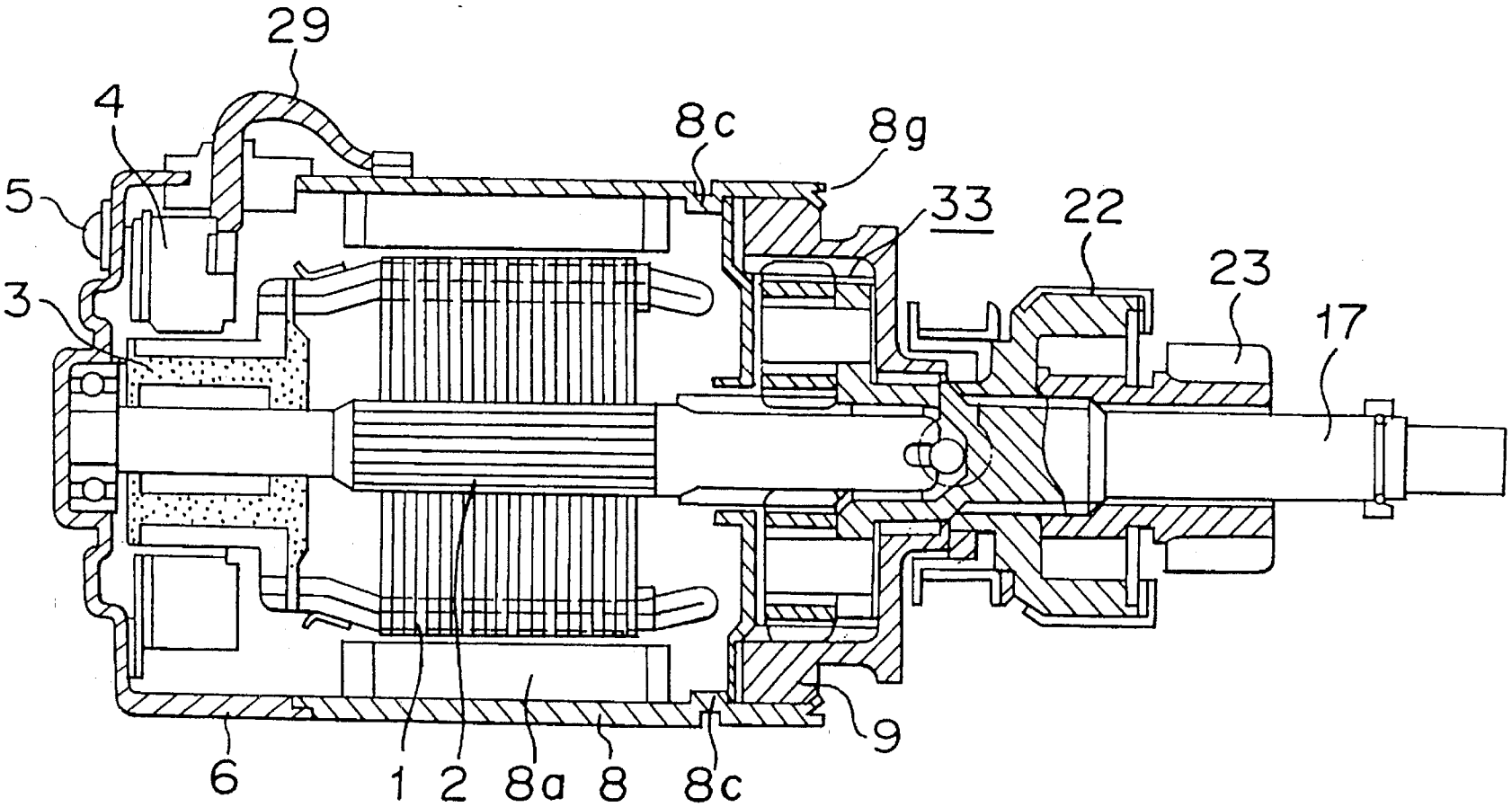
FIG. 11 is a cross-sectional view showing a seventh embodiment of the present invention.
Figure 12:
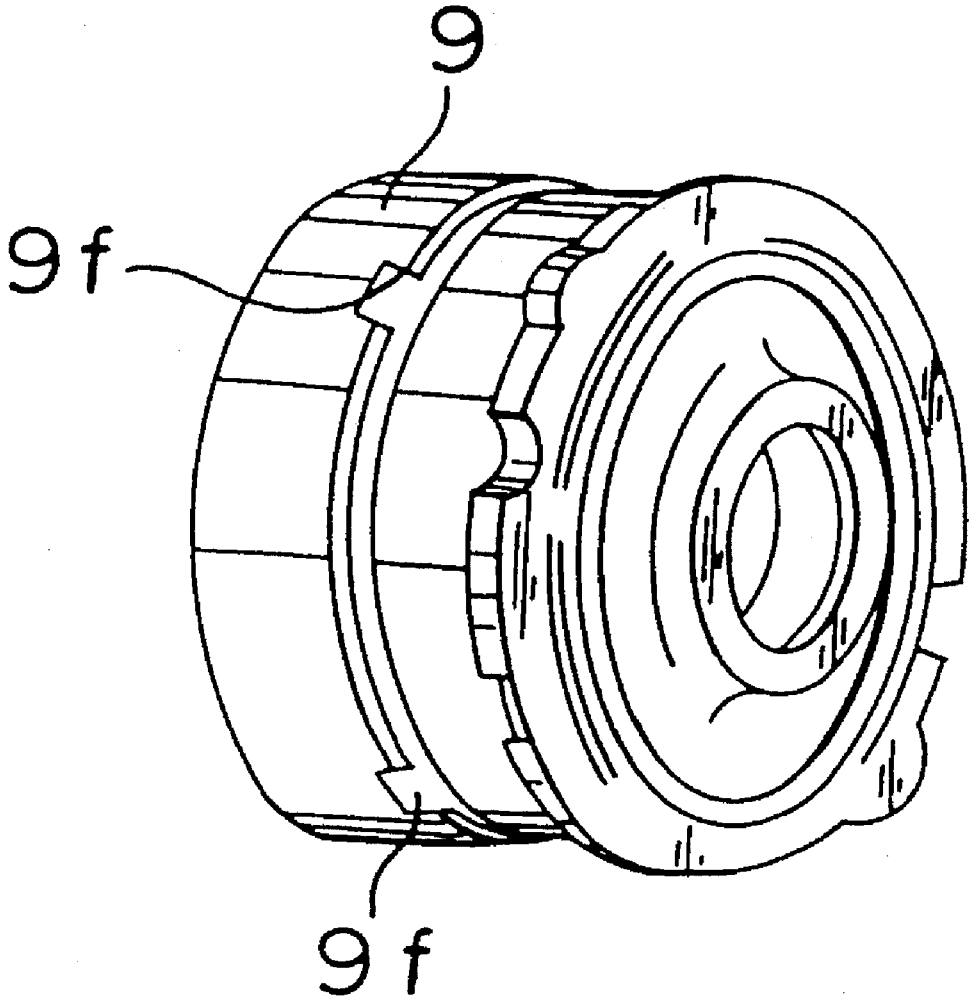
FIG. 12 is a perspective view showing an internal gear wheel portion used for the seventh embodiment of the present invention.

FIGS. 11 and 12 show the seventh embodiment which is a modification of the sixth embodiment. A recess or a notch 9*f* is formed in the outer circumferential surface of the internal gear wheel 9 at the position corresponding to the edge of the opening of the yoke 8, and appropriate portions of the edge of the opening of the yoke are subjected to bending to thereby fix the internal gear wheel 9 to the yoke 8. Numeral 8*g* indicates the portion to be bent.

EXAMPLE 8

Figure 13:
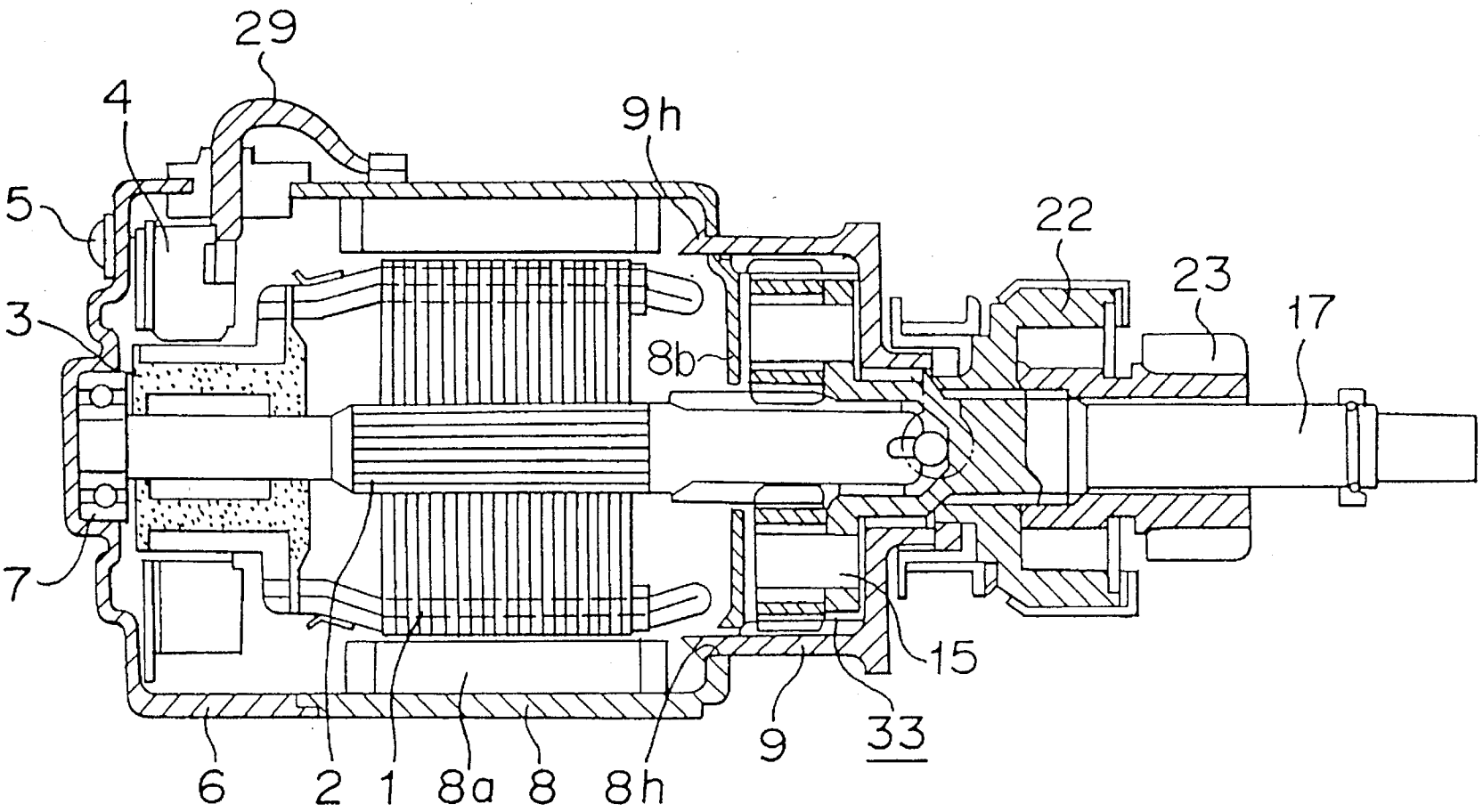
FIG. 13 is a cross-sectional view showing an eighth embodiment of the present invention.
Figure 14:
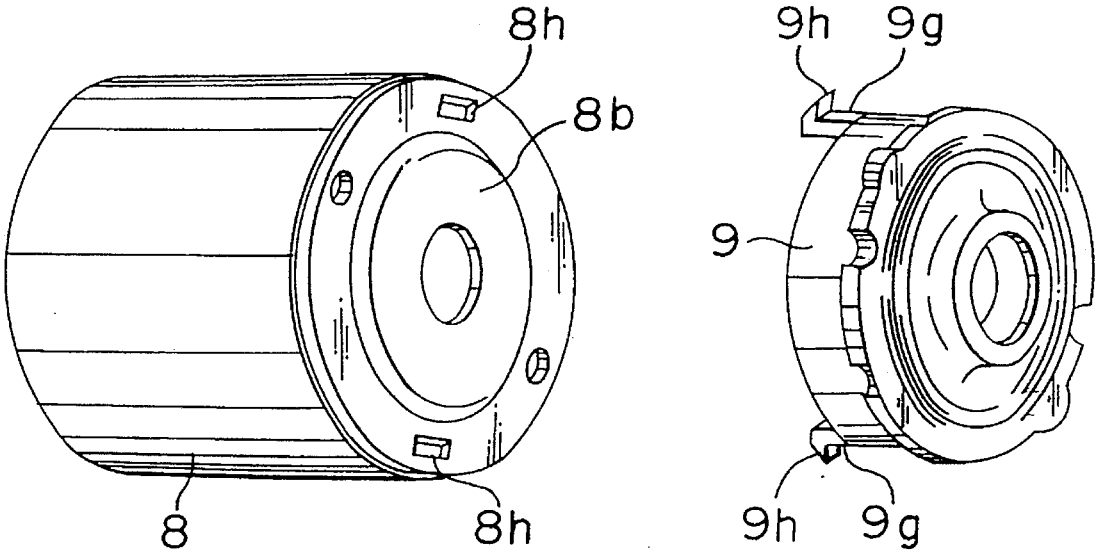
FIG. 14 is a perspective view showing a yoke and an internal gear wheel portion used for the eighth embodiment of the present invention.

FIGS. 13 and 14 show the eighth embodiment of the present invention. A plurality of engaging projections 9*g* are formed in the internal gear wheel 9 so as to extend in the axial direction toward the motor, and a plurality of engaging holes 8*h* are formed in a center plate 8*b* for the yoke 8. The engaging projections 9*g* are fitted to the engaging holes 8*h* by utilizing the elasticity of the engaging projection tips 9*h*, whereby the the planetary gear reduction device 9 is fixed to the yoke 8. In this case, the casing of the internal gear reduction device 9 may be made of synthetic resin.

EXAMPLE 9

Figure 15:
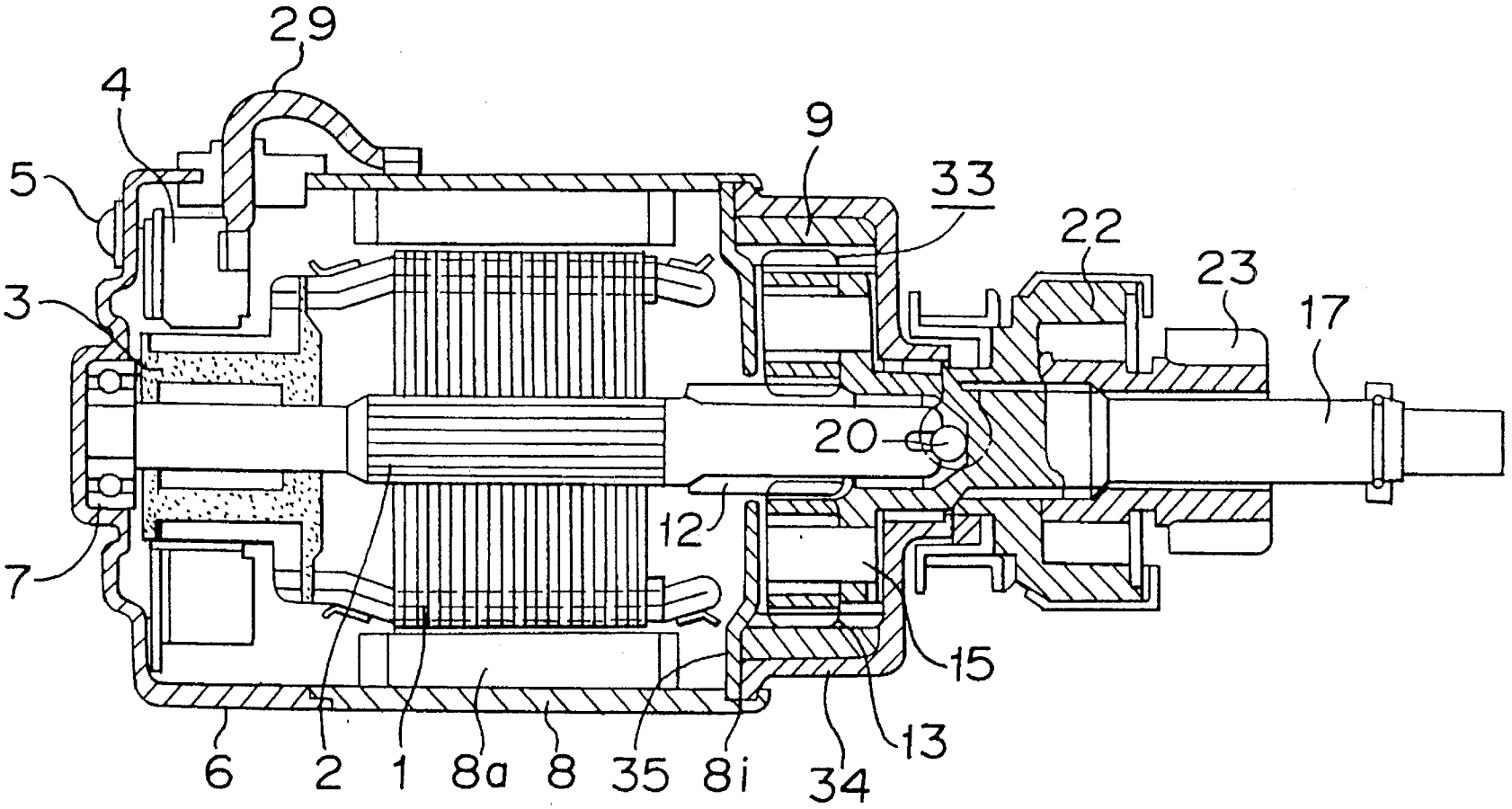
FIG. 15 is a cross-sectional view showing a ninth embodiment of the present invention.
Figure 16:
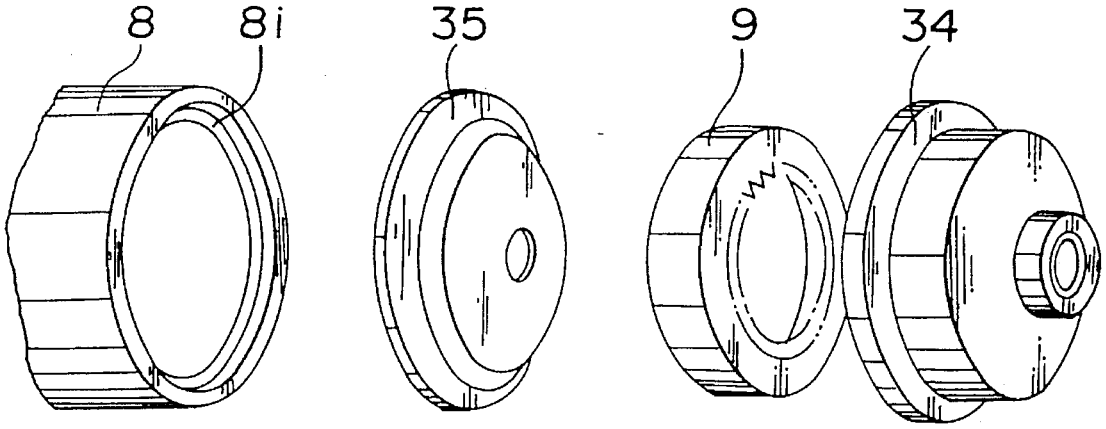
FIG. 16 is a perspective view in a disassembled state of important parts used for the ninth embodiment of the present invention.
Figure 17:
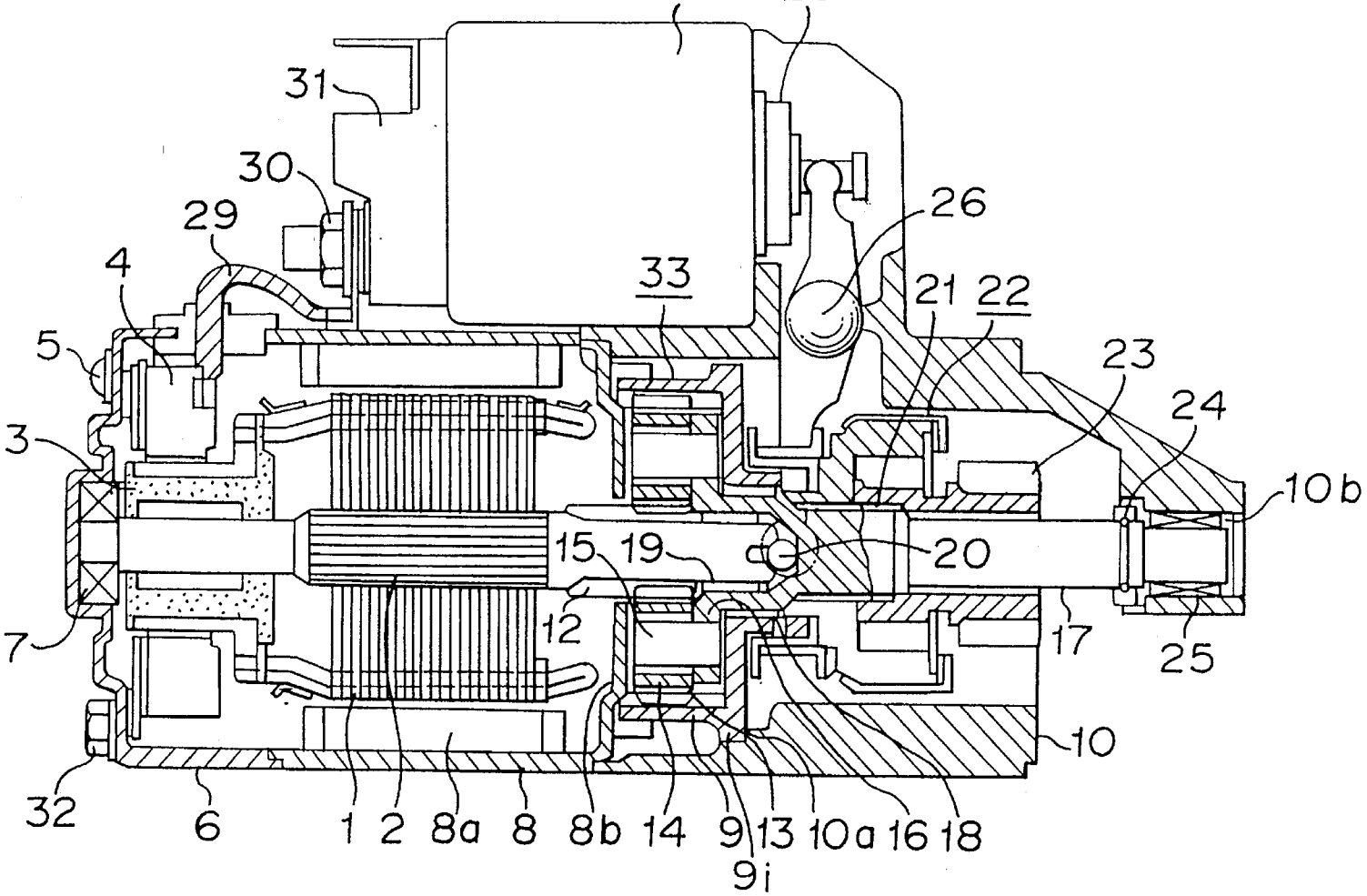
FIGURE 17 PRIOR ART
FIG. 17 is a cross-sectional view showing an embodiment of conventional planetary gear reduction starter.
Figure 18:
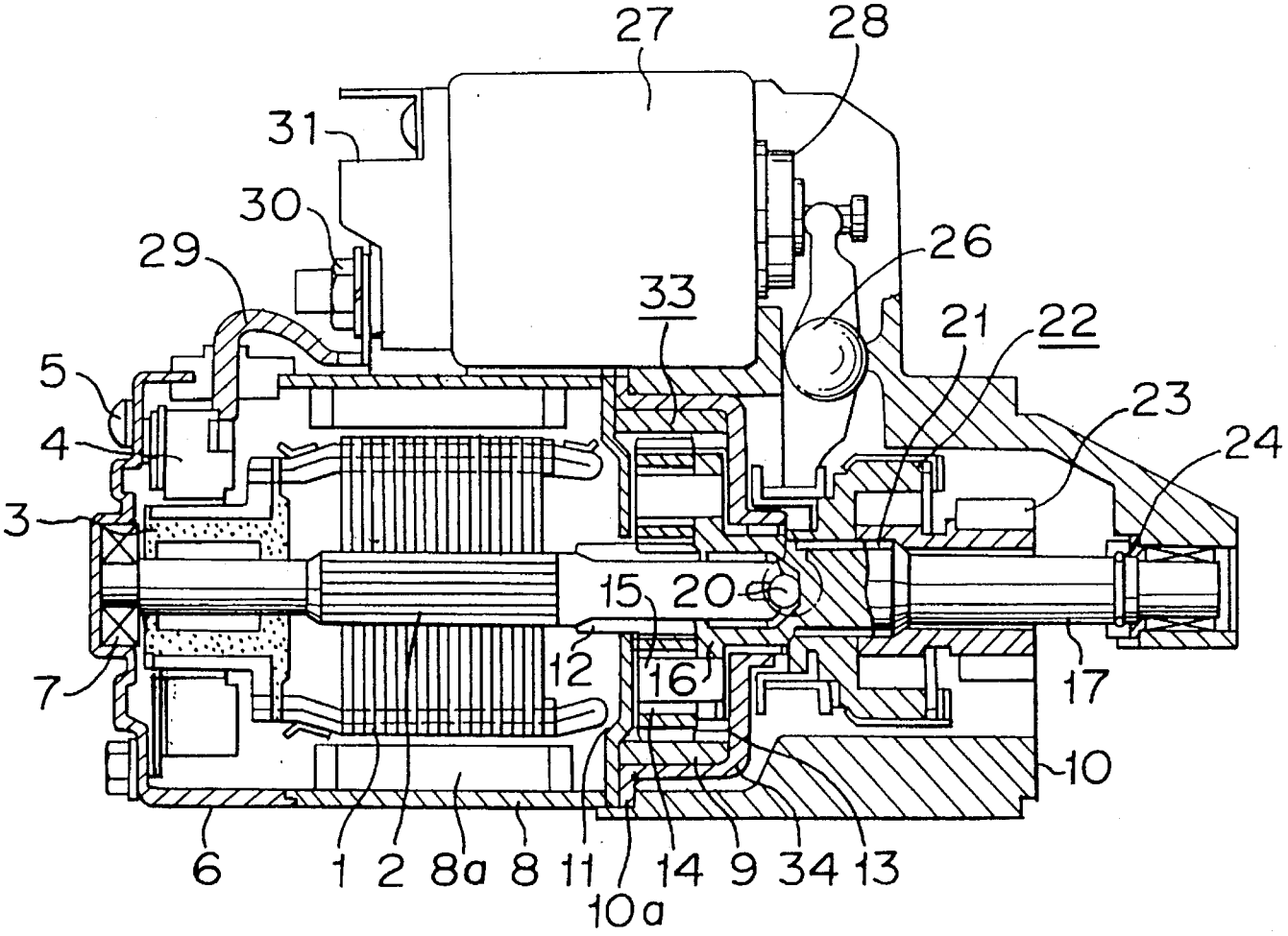
FIGURE 18 PRIOR ART
FIG. 18 is a cross-sectional view showing another embodiment of conventional planetary gear reduction starter.

FIGS. 15 and 16 show the ninth embodiment of the present invention, wherein an inlay 8*i* is formed at the edge of the opening of the yoke 8; an outer circumferential edge portion of a center plate 35 and a center bracket 34 are fitted to the inlay 8*i*, and then, the edge of the opening of the yoke is bent inwardly in the radial direction to fix the center plate 35 and the center bracket 34. With such construction, the fixture is reliable and strong without using another fixing member. The inlay 8*i* of the yoke may be formed by flaring.

Thus, in accordance with the present invention, it is possible to store and transport the assembly without having a switch, a lever and a front bracket while the planetary gear reduction device is firmly fixed to the yoke. The storage and transportation of the assembly without the front bracket are possible.

Further, in accordance with the present invention, the motor and the planetary gear reduction device can be fixed together even when a starter having different shape of front bracket and a different specification of switch is to be prepared. Accordingly, a large scale production is possible. Further, the assembly without the front bracket, the switch and the lever constitutes a uniform configuration, and accordingly, it is easy to store the assembly.

Obviously, numerous modifications and variations of the present invention are possible in light of the above teachings. It is therefore to be understood that within the scope of the appended claims, the invention may be practiced otherwise than as specifically described herein.

What is claimed is:

1. A planetary gear reduction starter sub-assembly, comprising:

a) a motor, b) a planetary gear reduction device connected to a front end portion of the motor, and c) an overrunning clutch slidably engaged with a helical spline formed in a rotary output shaft for the planetary gear reduction device, d) wherein the sub-assembly is adapted to be completed by the addition of a front bracket disposed in front of the motor to surround the planetary gear reduction device and the overrunning clutch, wherein the motor, the planetary gear reduction device, the rotary output shaft and the overrunning clutch are assembled in one piece in the absence of the front bracket, wherein a projection (8*c*) is formed in an inner circumferential surface and near the front end of a yoke of the motor, wherein a center plate (35) is disposed in contact with a front side of the projection, and wherein an internal gear wheel (9) of the planetary gear reduction device is forcibly fitted and secured to the inner circumferential surface of the yoke at the side of the center plate with respect to the projection.

2. A planetary gear reduction starter sub-assembly, comprising:

a ) a motor, b) a planetary gear reduction device connected to a front end portion of the motor, and c) an overrunning clutch slidably engaged with a helical spline formed in a rotary output shaft for the planetary gear reduction device, d) wherein the sub-assembly is adapted to be completed by the addition of a front bracket disposed in front of the motor to surround the planetary gear reduction device and the overrunning clutch, wherein the motor, the planetary gear reduction device, the rotary output shaft and the overrunning clutch are assembled in one piece in the absence of the front bracket, wherein a projection (8*c*) is formed in an inner circumferential surface and near the front end of a yoke of the motor, wherein a center plate (35) is disposed in contact with a front side of the projection, wherein an internal gear wheel (9) of the planetary gear reduction device is fitted to the front end of the inner circumferential surface of the yoke, and wherein a front edge (8*f*) of the yoke is inwardly deformed along a tapered portion (9*e*) formed at a front end of the internal gear wheel so that the internal gear wheel is fixed to the yoke by means of the deformed edge.

3. A planetary gear reduction starter sub-assembly, comprising:

a) a motor, b) a planetary gear reduction device connected to a front end portion of the motor, and c) an overrunning clutch slidably engaged with a helical spline formed in a rotary output shaft for the planetary gear reduction device, d) wherein the sub-assembly is adapted to be completed by the addition of a front bracket disposed in front of the motor to surround the planetary gear reduction device and the overrunning clutch, wherein the motor, the planetary gear reduction device, the rotary output shaft and the overrunning clutch are assembled in one piece in the absence of the front bracket, wherein a plurality of engaging projections (9*g*) are formed on an internal gear wheel (9) of the planetary gear reduction device and extend in an axial direction toward the motor, and wherein a plurality of engaging holes (8*h*) are formed in a center plate (8*b*) of a yoke of the motor so that the engaging projections are fitted into the engaging holes by utilizing elasticity.

* * * * *